US011498089B2

(12) United States Patent
Arminak

(10) Patent No.: US 11,498,089 B2
(45) Date of Patent: Nov. 15, 2022

(54) ALL PLASTIC CONTINUOUS SPRAY TRIGGER SPRAYER

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 0 days.

(21) Appl. No.: 17/464,568

(22) Filed: Sep. 1, 2021

(65) Prior Publication Data

US 2022/0314251 A1 Oct. 6, 2022

Related U.S. Application Data

(60) Provisional application No. 63/170,544, filed on Apr. 4, 2021.

(51) Int. Cl.
*B05B 11/00* (2006.01)

(52) U.S. Cl.
CPC ..... *B05B 11/304* (2013.01); *B05B 11/3057* (2013.01)

(58) Field of Classification Search
CPC ..... B05B 11/304; B05B 11/3057
See application file for complete search history.

(56) References Cited

U.S. PATENT DOCUMENTS 3,138,301 A * 6/1964 Ward ..... B65D 83/546 222/335
3,282,472 A 11/1966 Roder
3,430,826 A 3/1969 Microulis
D220,832 S 6/1971 Lapidus
3,726,442 A * 4/1973 Davidson ..... B05B 11/0044 222/207
3,873,023 A 3/1975 Moss et al.
4,036,438 A * 7/1977 Soderlind ..... B05B 9/0861 239/288.5
4,146,155 A * 3/1979 Kutik ..... B05B 11/3014 222/109
4,155,487 A * 5/1979 Blake ..... B05B 11/3011 222/207
4,174,056 A * 11/1979 Loeffler ..... B05B 11/3004 222/321.7
4,191,313 A * 3/1980 Blake ..... B05B 11/0064 222/335
4,241,853 A * 12/1980 Pauls ..... B05B 9/0883 222/207

(Continued)

FOREIGN PATENT DOCUMENTS

EP 2344280 B1 1/2016
JP H07101480 A * 4/1995 ..... B05B 11/3049

(Continued)

*Primary Examiner* — Bob Zadeh
(74) *Attorney, Agent, or Firm* — Cislo & Thomas, LLP

(57) ABSTRACT

A manually operated trigger sprayer that stores a quantity of pressurized liquid during the charge stroke of the trigger for subsequent release during the return stroke, is presented. The trigger sprayer is configured such that an appreciable volume of liquid is dispensed during both the charge and the return strokes of the trigger, creating a continuous discharge stream, for so long as the trigger is actuated. The present invention trigger sprayer also provides an all plastic construction by replacing the metal coil spring of prior art trigger sprayers with a U-shaped plastic spring located exterior to the pump housing thereby making the trigger sprayer well-suited for recycling.

20 Claims, 3 Drawing Sheets

(56) References Cited

U.S. PATENT DOCUMENTS

| | | | | |
|---|---|---|---|---|
| D267,780 | S | 2/1983 | Walter | |
| 4,371,097 | A | 2/1983 | O'Neil | |
| 4,527,741 | A * | 7/1985 | Garneau | B05B 11/00 239/333 |
| 4,591,077 | A * | 5/1986 | Corsette | B05B 11/3004 222/321.3 |
| 5,303,865 | A | 4/1994 | Bert | |
| 5,363,993 | A | 11/1994 | Mascitelli | |
| 5,673,824 | A | 10/1997 | Evans | |
| 5,711,459 | A * | 1/1998 | Glynn | B05B 11/3009 222/318 |
| D392,887 | S | 3/1998 | Wadsworth | |
| D396,639 | S | 8/1998 | Pedersen-Resk | |
| 5,803,318 | A | 9/1998 | Lina | |
| D406,761 | S | 3/1999 | Garcia | |
| D415,427 | S | 10/1999 | Durliat | |
| D418,418 | S | 1/2000 | Wadsworth | |
| D420,288 | S | 2/2000 | Garcia | |
| D424,938 | S | 5/2000 | Wise | |
| D427,527 | S | 7/2000 | Wise | |
| D429,642 | S | 8/2000 | Garcia | |
| D438,468 | S | 3/2001 | Wadsworth | |
| D439,842 | S | 4/2001 | Garcia | |
| D441,654 | S | 5/2001 | Sayers | |
| 6,290,145 | B1 | 9/2001 | Mizushima et al. | |
| D452,822 | S | 1/2002 | Boshuizen | |
| D466,017 | S | 11/2002 | Kuo | |
| 6,478,197 | B2 | 11/2002 | Bethune | |
| D471,105 | S | 3/2003 | Gonzalez Fernandez | |
| D478,273 | S | 8/2003 | Derman | |
| D499,966 | S | 12/2004 | Arminak | |
| 6,896,192 | B2 | 5/2005 | Horan et al. | |
| D515,420 | S | 2/2006 | Gardet | |
| D516,909 | S | 3/2006 | Bloc | |
| D528,913 | S | 9/2006 | Penfold | |
| D529,549 | S | 10/2006 | Lapierre | |
| D536,972 | S | 2/2007 | van der Heijden | |
| D539,648 | S | 4/2007 | Arminak | |
| D547,655 | S | 7/2007 | van der Heijden | |
| D547,657 | S | 7/2007 | Tacchella | |
| 7,246,723 | B2 | 7/2007 | Santagiuliana | |
| D548,079 | S | 8/2007 | van der Heijden | |
| D552,471 | S | 10/2007 | Kuus | |
| D558,590 | S | 1/2008 | Cowan-Hughes | |
| D567,655 | S | 4/2008 | Arminak | |
| D568,154 | S | 5/2008 | Arminak | |
| D574,707 | S | 8/2008 | Pietrowski | |
| D586,212 | S | 2/2009 | Allen | |
| D588,006 | S | 3/2009 | Boes | |
| D595,132 | S | 6/2009 | Tseng | |
| D598,750 | S | 8/2009 | Boes | |
| 7,578,417 | B2 | 8/2009 | Son | |
| D599,667 | S | 9/2009 | Gedmin | |
| 7,942,291 | B2 * | 5/2011 | Foster | B05B 11/3011 222/384 |
| D649,457 | S | 11/2011 | Rowen | |
| D668,151 | S | 10/2012 | Abbondanzio | |
| D706,133 | S | 6/2014 | Robinson | |
| D714,642 | S | 10/2014 | Wang | |
| D716,665 | S | 11/2014 | O'Donahue | |
| D723,381 | S | 3/2015 | O'Donahue | |
| D730,733 | S | 6/2015 | O'Donahue | |
| D731,888 | S | 6/2015 | O'Donahue | |
| D767,392 | S | 9/2016 | Landrum | |
| D778,998 | S | 2/2017 | Musselman | |
| D801,171 | S | 10/2017 | Eziquiel-Shriro | |
| D810,566 | S | 2/2018 | Kuo | |
| 9,937,509 | B2 | 4/2018 | DeJong | |
| 9,962,723 | B2 | 5/2018 | Baughman | |
| 10,226,037 | B2 | 3/2019 | States, III et al. | |
| 10,335,816 | B1 | 7/2019 | Arminak | |
| D874,297 | S | 2/2020 | Nabeta | |
| D876,234 | S | 2/2020 | Arminak | |
| D883,100 | S | 5/2020 | Yen | |
| 2003/0116588 | A1 | 6/2003 | Santagiuliana | |
| 2005/0090414 | A1 | 4/2005 | Rich | |
| 2005/0115990 | A1 | 6/2005 | Kang | |
| 2008/0000933 | A1 | 1/2008 | Marelli | |
| 2009/0039110 | A1 | 2/2009 | Brouwer | |
| 2011/0017779 | A1 | 1/2011 | Rossignol | |
| 2011/0240677 | A1 | 10/2011 | Dwyer | |
| 2013/0228482 | A1 | 9/2013 | Son | |
| 2015/0090741 | A1 | 4/2015 | Laffey | |
| 2016/0332181 | A1 | 11/2016 | DeMan | |
| 2017/0128966 | A1 | 5/2017 | Law | |
| 2017/0128967 | A1 | 5/2017 | Law | |
| 2017/0265891 | A1 | 9/2017 | Ophardt et al. | |
| 2017/0326567 | A1 | 11/2017 | Santagiuliana | |
| 2017/0368564 | A1 | 12/2017 | Baker | |
| 2019/0083995 | A1 | 3/2019 | Knight | |
| 2020/0148526 | A1 | 5/2020 | Rittenburg | |
| 2020/0290793 | A1 | 9/2020 | Driskell | |
| 2020/0331015 | A1 | 10/2020 | Lee | |
| 2021/0000306 | A1 | 1/2021 | Arminak | |
| 2021/0310469 | A1 | 10/2021 | Huang | |

FOREIGN PATENT DOCUMENTS

| | | | | |
|---|---|---|---|---|
| JP | 8332419 | A | 12/1996 | |
| JP | 2014166624 | A * | 9/2014 | B05B 11/304 |
| JP | 2017185491 | A | 10/2017 | |
| JP | 6743199 | B2 | 8/2020 | |
| NZ | 333673 | A | 11/2000 | |

* cited by examiner

ALL PLASTIC CONTINUOUS SPRAY TRIGGER SPRAYER

CROSS-REFERENCES TO RELATED APPLICATION

This application claims the benefit of U.S. Provisional Application Ser. No. 63/170,544, filed Apr. 4, 2021 and entitled "All Plastic Continuous Spray Trigger," which is incorporated herein by this reference.

BACKGROUND OF THE INVENTION

Field of the Invention

The present invention relates to hand held and hand operated liquid dispensing pumps commonly referred to as trigger sprayers.

Background Art

The present invention pertains to trigger sprayers which are connectable to a separate dispenser container containing a liquid. The trigger sprayers have a hand operated trigger that is used to operate a pump in the sprayer. The pump draws liquid from the dispenser container and dispenses it through a nozzle via a liquid flow path. A pressure regulating valve within the liquid flow path and downstream of the pump prevents the flow of liquid to the nozzle until the liquid is raised to at least a minimum fluid pressure level. When the fluid pressure reaches a preset minimum level, the pressure regulating valve opens to permit liquid to be dispensed through the valve and out the nozzle. The nozzles used in trigger sprayers are commonly operable to block and allow liquid flow and to adjust the dispersal pattern of the flow, i.e. flow may be adjusted from a fine mist to a liquid stream.

Many trigger sprayer designs have previously been developed and are in widespread use for dispensing a variety of liquid products. Prior art sprayers, though functional, nevertheless possess certain drawbacks. One drawback is that prior art trigger sprayers dispense liquid for only so long as the trigger is being depressed. Upon the start of the return stroke of the trigger, the flow of liquid ceases until the next charge stroke of the trigger, i.e. until the next time that the trigger is pulled.

Another drawback of many prior art trigger sprayers is that they use a metal pump or trigger return spring, typically in the form of a metal coil spring. Consequently, in order to recycle such trigger sprayers, they must first be disassembled in order to remove the metal spring. The disassembly requirement increases recycling costs and makes trigger sprayers less desirable as a source of recyclable plastic.

As discussed above, there is room for improvement in the art of trigger sprayer design. What is needed in the art is a trigger sprayer that is able to continue dispensing fluid during the return stroke of the lever so that there is no appreciable drop off in fluid being dispensed between each charge stroke of the trigger. There is further a need for a trigger sprayer made of all plastic components. Such a design would make trigger sprayers more cost effective to recycled and therefore more desirable as a source of recyclable plastic.

SUMMARY OF THE INVENTION

The trigger sprayer of the present invention overcomes the disadvantages typically associated with prior art trigger sprayers by providing a trigger sprayer design that stores a quantity of pressurized liquid during the charge stroke of the trigger for subsequent release during the return stroke. Consequently, an appreciable volume of liquid is dispensed during both the charge and the return strokes of the trigger creating a continuous discharge stream so long as the trigger is actuated. The present invention trigger sprayer also provides an all plastic construction by replacing the metal coil spring of prior art trigger sprayers with a U-shaped plastic spring located exterior to the pump housing. Consequently, the all plastic trigger sprayer of the present invention is well-suited for recycling.

The trigger sprayer of the present invention includes a sprayer housing having a liquid supply passage, a pump chamber and a liquid discharge passage integrally formed with the housing. The sprayer housing is attached to the neck of a dispenser container containing a fluid to be dispensed, by means of a closure. The closure attaches to the dispenser container neck typically by means of screw threads. Alternatively, bayonet-style or similar mounts could be used. The liquid supply passage has a first end and a second end, where the first end serves as a liquid inlet and is in fluid communication with the liquid to be dispensed in the dispenser container by means of a dip tube.

The liquid discharge passage also includes a first end and a second end, where the first end of the liquid discharge passage connects to and is in fluid communication with the second end of liquid supply passage. The pump chamber, integrally formed as part of the sprayer housing, is in fluid communication with the liquid supply passage at a position in-between a lower or input check valve and an upper or output check valve, both of which are located in the liquid supply passage. That is, the pump chamber is located downstream of the input check valve and upstream of the output check valve.

The input check valve controls the flow of liquid from the liquid inlet to the pump chamber. That is, the input check valve controls the flow of liquid from the dispenser container into the pump chamber, where the liquid is drawn from the dispenser container via the dip tube and into the liquid supply passage via the liquid inlet at the first end of the liquid supply passage. The output check valve controls the flow of liquid from the pump chamber into the liquid discharge passage.

The second end of the liquid discharge passage has a liquid outlet opening to which is attached a nozzle assembly. Disposed within the liquid discharge passage adjacent to or upstream of the nozzle assembly is a discharge valve. The discharge valve is configured to open and allow liquid to be dispensed only when the liquid within the liquid discharge passage reaches a predetermined pressure.

The nozzle assembly is rotatable relative to the liquid discharge passage to selectively close and open the liquid flow path through the liquid discharge passage and includes multiple open positions that allow a user to select between spray or stream discharge patterns.

Disposed at the second end of the liquid supply passage, proximate to the first end of the liquid discharge passage and above or downstream of the output valve is an elastic tube. The elastic tube is in fluid communication with the liquid supply passage and the liquid discharge passage. The elastic tube functions to store liquid under pressure during a charge stroke of the trigger and to deliver pressurized liquid to the liquid discharge passage during a return stroke of the actuator.

A piston is mounted within the pump chamber. The piston is connected to the trigger via a pitman link. The piston reciprocates between charge and return positions in concert with the trigger being pulled and subsequently released by a user. The trigger is pivotally connected to the housing via pivots located on an exterior surface of the liquid discharge passage, proximate to the second end of the tube.

A plastic return spring having a pair of interconnected U-shaped spring arms attaches to a base of the housing at a lower end and to the trigger at an upper end. The U-shaped spring arms extend upwardly from the base about the exterior of the pump chamber. The return spring functions to return the trigger to its charge, i.e. forward position, after being pulled or depressed.

A charge stroke of the trigger is defined as moving the trigger from its at rest position to the its fully depressed position. On a charge stroke, the trigger moves inwardly towards the sprayer housing and against the force of the return spring. A return stroke is defined as moving the trigger from its fully depressed position to its at rest position. On a return stroke, the trigger moves outwardly away from the sprayer housing. On a return stroke, the trigger is driven from its fully depressed position to its at rest position by the force of the return spring.

The charge position of the trigger or piston is defined as the location of those components when in their at rest position. The return position of the trigger and the piston are defined as the location of those components when the trigger is fully depressed. Inward movement of the piston or trigger refers to movement towards the liquid supply passage of the sprayer housing. Outward movement of the trigger or piston refers to movement away from the liquid supply passage.

The trigger sprayer of the present invention functions as follows.

The first full operating cycle of the trigger sprayer primes the system. In a first step, the trigger is pulled from its charge or at rest position to its return or fully depressed position. On the charge stroke, as the trigger is pulled, the return spring is compressed and the piston moves inwardly within the pump chamber. As the piston moves inwardly, pressure increases inside the liquid supply passage causing the input check valve to close and the output check valve and the discharge valve to open forcing air to exit thru the liquid outlet of the liquid discharge passage.

In a second step, the trigger is released and returns from the return position to the charge position due to the force exerted by the return spring. On the return stroke, the piston moves outwardly which creates vacuum within the pump chamber and the liquid supply passage which in turn causes the output check valve and discharge valve to close and the input check valve to open which allows liquid to be drawn from the dispenser container into the liquid supply passage and the pump chamber via the dip-tube in the dispenser container.

Each subsequent operating cycle of the trigger sprayer dispenses fluid from the nozzle. In particular, when the trigger is pulled for the second time and on each subsequent pull, the return spring is compressed and the piston moves inwardly within the pump chamber pressurizing the liquid within the chamber. As the piston moves inwards, the input check valve is closed, and the output check valve is opened due to liquid pressurization inside the housing. The discharge valve opens when the pressure exceeds a predetermined level causing the liquid to move through the open output check valve where a portion of the liquid enters the liquid discharge passage and a portion of the liquid enters the elastic tube causing the elastic tube to inflate with liquid and pressurize. Upon the discharge valve reaching a predetermined pressure, liquid is dispensed from the liquid discharge passage via the nozzle.

On the second and each subsequent return stroke of the trigger and the piston connected thereto, vacuum in the pump chamber closes the output check valve and pressurized liquid stored in the elastic tube is supplied to the liquid discharge passage where it is dispensed from the nozzle. Simultaneously, the vacuum within the pump chamber opens the input check valve allowing fresh liquid to be drawn from the dispenser container into the liquid supply passage and the pump chamber via the dip-tube in the dispenser container. Thus, each operating cycle of the trigger sprayer after the first cycle causes liquid to be dispensed in a continuous stream on both the charge and return strokes of the trigger and the piston connected thereto.

In order to equalize pressure between the interior of the dispenser container and the atmosphere, the interior of the dispenser container must be vented. In the trigger sprayer of the present invention, venting of the dispenser container is achieved by the inclusion of an air vent in a dip tube retainer element which attaches to the closure and which provides air flow from the dispenser container to an air vent in the pump chamber. The pump chamber air vent is blocked by the piston when the piston is in the charge or at rest position. Venting occurs when the trigger is pulled causing the piston to move inwardly and thereby unblock the pump chamber air vent. When unblocked, the pump chamber air vent allows air from the atmosphere to pass through to the dispenser container via the air vent in the dip tube retainer.

The above and other advantages of the trigger sprayer of the present invention will be described in more detail below.

DETAILED DESCRIPTION OF THE PREFERRED EMBODIMENTS

The present invention will now be described more fully hereinafter with reference to the accompanying drawings, in which preferred embodiments of the invention are shown. The invention may, however, be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

As discussed above, the trigger sprayer of the present invention 10 provides a trigger sprayer design that stores a quantity of pressurized liquid during the charge stroke of the trigger for subsequent release during the return stroke. Consequently, an appreciable volume of liquid is dispensed during both the charge and the return strokes of the trigger creating a continuous discharge stream of fluid. The trigger sprayer of the present invention 10 also provides an all plastic construction by replacing the metal coil spring of prior art trigger sprayers with a U-shaped plastic spring located exterior of the pump housing. The all plastic construction renders the trigger sprayer 10 well-suited for recycling.

Figure 1:
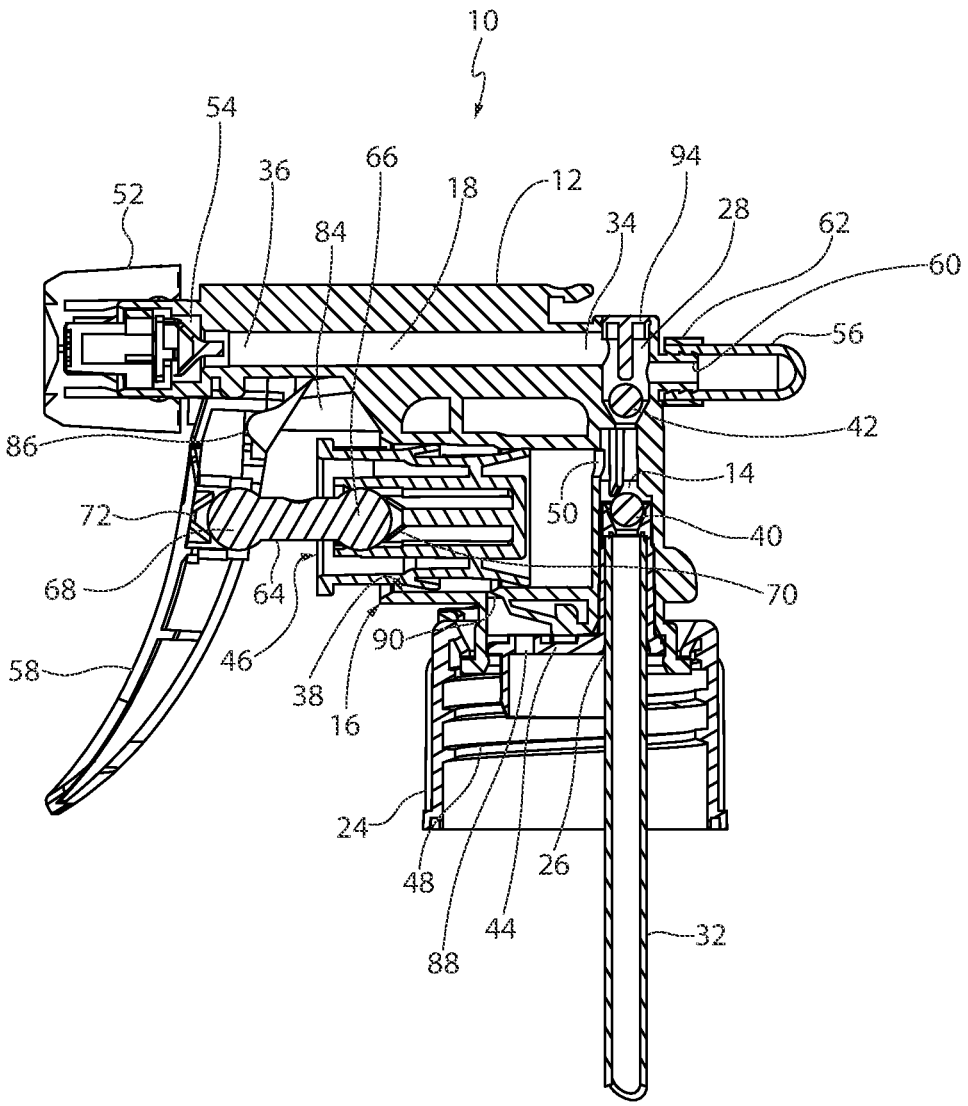
FIG. 1 is a side sectional view of the trigger sprayer of the present invention with the trigger in the forward position relative to the sprayer housing. The shroud of the trigger sprayer has been removed for clarity.
Figure 2:
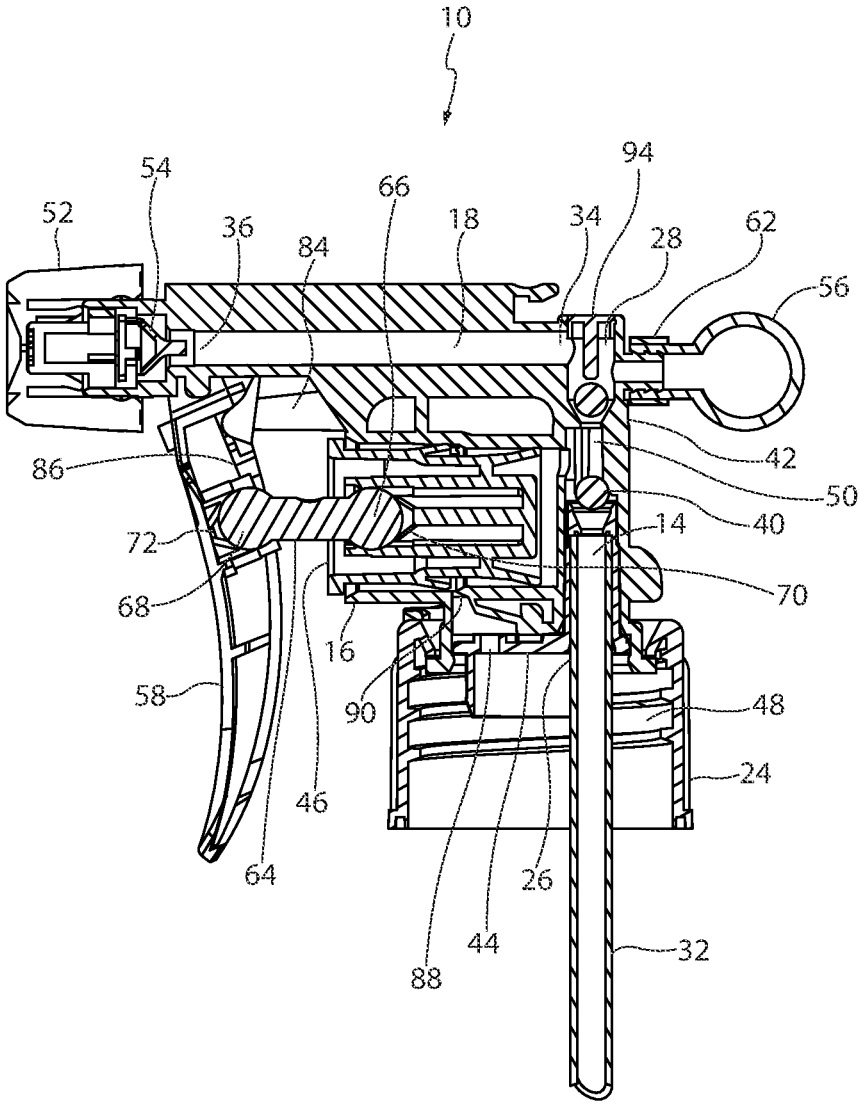
FIG. 2 is a side sectional view of the trigger sprayer of FIG. 1 with the trigger in the rearward position relative to the sprayer housing. The shroud of the trigger sprayer has been removed for clarity.
Figure 3:
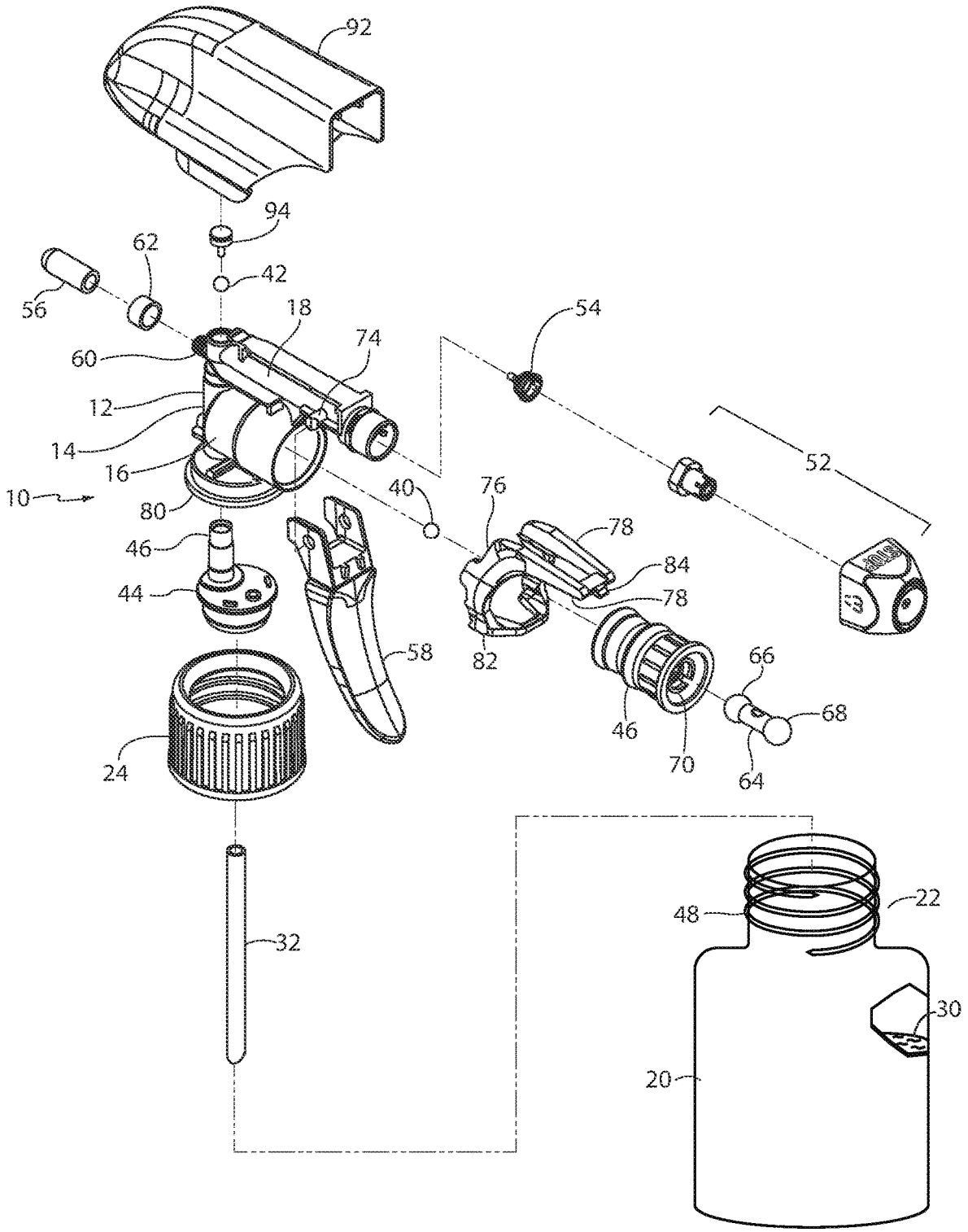
FIG. 3 is an exploded perspective view of the trigger sprayer of FIG. 1.

With reference to FIGS. 1-3, the trigger sprayer of the present invention 10 includes a sprayer housing 12 having a liquid supply passage 14, a pump chamber 16 and a liquid discharge passage 18, each of which is formed within the sprayer housing 12. The sprayer housing 12 is attached to the neck 22 of a dispenser container 20 containing a liquid 30 to be dispensed, by means of a closure 24. The closure 24 attaches to the neck 22 of the dispenser container by means of either screw threads 48 or a bayonet-style or like mount. The liquid supply passage 14 has a first end 26 and a second end 28, where the first end is in fluid communication with the liquid 30 to be dispensed in the dispenser container 20 by means of a dip tube 32. A dip tube retainer 44 is connected to the first end 26 of the liquid supply passage 14 and functions to suspend the dip tube 32 in the dispenser container 20.

The liquid discharge passage 18 also includes a first end 34 and a second end 36. The first end 34 of the liquid discharge passage 18 connects to and is in fluid communication with the second end 28 of liquid supply passage 14. The second end 36 serves as the liquid discharge end or opening of the liquid discharge passage 18.

The pump chamber 16 is integrally formed as part of the sprayer housing 12 and has a cylindrical bore 38 which receives a piston 46. The pump chamber 16 is in fluid communication with the liquid supply passage 14 at a port 50 disposed in a common wall between the pump chamber 16 and the liquid supply passage 14.

The liquid supply passage 14 also includes a lower or input check valve 40 and an upper or output check valve 42. Both the input check valve 40 and the output check valve 42 are configured as ball style check valves in the exemplary embodiment.

The port 50 in the common wall between the liquid supply passage 14 and the pump chamber 16 is disposed above the input check valve 40 and below the output check valve 42, i.e. the port 50 is disposed in the liquid supply passage 14 in-between the input check valve 40 and the output check valve 42.

The input check valve 40 controls the flow of liquid 30 from the liquid supply passage 14 into the pump chamber 16. That is, the input check 40 valve controls the flow of liquid 30 from the dispenser container 20 through the port 50 in the common wall between the pump chamber 16 and the liquid supply passage 14, where the liquid is drawn from the dispenser container 20 via the dip tube 32. The output check valve 42 controls the flow of liquid from the pump chamber 16 into the liquid discharge passage 18.

The second end 36 of the liquid discharge passage 18 has a liquid outlet opening to which is attached a nozzle assembly 52. Disposed within the liquid discharge passage 18 adjacent to the nozzle assembly 52 is a pressure operated discharge valve 54. The discharge valve 54 is configured to open and allow liquid 30 to be dispensed only when the liquid within the liquid discharge passage 18 reaches a predetermined pressure.

The nozzle assembly 52 is rotatable relative to the liquid discharge passage 18 to selectively close and open the liquid discharge passage 18 and includes multiple open positions that allow a user to select between spray or stream discharge patterns.

Disposed at the second end 28 of the liquid supply passage 14, proximate to the first end 34 of the liquid discharge passage 18 and above the output check valve 42 is an elastic tube or elastic liquid storage element 56. The elastic tube 56 is in fluid communication with the liquid supply passage 14 and the liquid discharge passage 18 and functions to store liquid under pressure during a charge stroke of a trigger 58 and to deliver pressurized liquid to the liquid discharge passage 18 during a return stroke of the trigger 58.

The sprayer housing 12 includes a nipple 60 that extends rearwardly from the back of sprayer housing proximate to the second end 28 of the liquid supply passage 14. The elastic tube 56 is attached to the nipple 60 via a tube lock 62. The nipple 60 is in fluid communication with the liquid supply passage 14 and the elastic tube 56.

The piston 46 is slideably disposed within the pump chamber 16 and is connected to the trigger 58 via a pitman link 64. The pitman link 64 is configured with ball ends 66 and 68 that engage with pockets 70 and 72, respectively, on the piston 46 and the trigger 58. The pockets 70 and 72 are configured to engage the ball ends 66 and 68, respectively, via snap fits. The piston 46 reciprocates between a charge position and a return position in concert with the trigger 58 being pulled and released by a user. The trigger 58 is pivotally connected to the sprayer housing 12 via pivots 74 (one side shown in FIG. 3) located on an exterior surface of the sprayer housing 12 proximate to the second end 36 of the liquid discharge passage.

The trigger sprayer 10 includes a plastic return spring 76 having a spring base or first end 82 from which extend upwardly a pair of interconnected U-shaped spring arms 78 which terminate in an upper engagement prong or second end 84. All components of the return spring 76 are formed monolithically as a single piece.

The spring base 82 of the return spring 76 attaches to a base 80 of the sprayer housing 12 via a snap fit. The engagement prong 84 of the return spring 76 engages an engagement pocket 86 of the trigger 58. The U-shaped spring arms 78 extend upwardly from the spring base 82 about the exterior of the pump chamber 16. Depression of the trigger 58 causes the spring arms 78 to be displaced rearwardly which loads the spring arms. Upon release of the trigger 58, the spring arms 78 seek to return to their static or at rest position and thereby cause the trigger to return to its static or at rest position. Thus, the return spring 76 functions to return the trigger 58 to its charge, i.e. static or at rest position, after being pulled or depressed.

The trigger sprayer 10 will typically also include a shroud 92 which serves to cover and protect the sprayer housing 12, elastic tube 56 and return spring 76, as well as to provide the trigger sprayer with a pleasing esthetic appearance. The trigger sprayer 10 also includes a retainer cap 94 which serves to retain the check ball of the output check valve 42.

Definitions Regarding Operating Positions

FIG. 1 shows the position of the trigger 58 and piston 46 in their charge or at rest positions. FIG. 2 shows the position of the trigger 58 and piston 46 in their return or fully depressed positions.

With reference to FIGS. 1-2, a charge stroke of the trigger 58 is defined as moving the trigger from its at rest position to its fully depressed position. On a charge stroke, the trigger 58 moves inwardly towards the sprayer housing 12 and against the force of the return spring 76. A return stroke is defined as moving the trigger 58 from its fully depressed position to its at rest position. On a return stroke, the trigger 58 moves outwardly away from the sprayer housing 12. On a return stroke, the trigger 58 is driven from its fully, depressed position to its at rest position by the force of the compressed return spring 76. The charge position of the trigger 58 or piston 46 is defined as the location of those components when in their at rest position. The return position of the trigger 58 and the piston 46 are defined as the location of those components when the trigger is fully depressed. Inward movement of the piston 46 or trigger 58 refers to movement towards the sprayer housing 12. Outward movement of the trigger 58 or piston 46 refers to movement of away from the sprayer housing 12.

Operation of the Trigger Sprayer

With reference to FIGS. 1-2, the trigger sprayer of the present invention 10 functions as follows. The first full operating cycle of the trigger sprayer 10 primes the system. In a first step, the trigger 58 is pulled from its charge or at rest position to its return or fully depressed position. On the charge stroke, as the trigger 58 is pulled, the return spring 76 is compressed and the piston 46 moves inwardly within the pump chamber 16. As the piston moves inwardly, pressure increases inside the liquid supply passage 14 causing the input check valve 40 to close and the output check valve 42 and the discharge valve 54 to open forcing air to exit thru the second end 36 of the liquid discharge passage 18 via the nozzle assembly 52.

In a second step, the trigger 58 is released and returns from the return position to the charge position due to the force exerted by the return spring 76. On the return stroke, the piston 46 moves outwardly which creates vacuum within the pump chamber 16 and the liquid supply passage 14 which in turn causes the output check valve 42 and discharge valve 54 to close and the input check valve 40 to open which allows liquid 30 to be drawn from the dispenser container 20 into the liquid supply passage 14 and the pump chamber 16 via the dip-tube 32 in the dispenser container.

Each subsequent operating cycle of the trigger sprayer 10 dispenses liquid 30 from the nozzle assembly 52. In particular, when the trigger 58 is pulled for the second time and on each subsequent pull, the return spring 76 is compressed and the piston 46 moves inwardly within the pump chamber 16 pressurizing the liquid 30 within the chamber. As the piston 46 moves inwards, the input check valve 40 is closed, and the output check valve 42 is opened due to liquid pressurization inside the liquid supply, passage 14, causing liquid 30 to move through the open output check valve 42 where a portion of the liquid enters the liquid discharge passage 18 and a portion of the liquid enters the elastic tube 56 causing the elastic tube to inflate with liquid and pressurize. Upon the discharge valve 54 reaching a predetermined pressure, liquid 30 is dispensed from the liquid discharge passage 18 via the nozzle assembly 52.

On the second and each subsequent return stroke of the trigger 58 and the piston 46 connected thereto, vacuum in the pump chamber 16 closes the output check valve 42 and pressurized liquid stored in the elastic tube 56 is supplied to the liquid discharge passage 18 where it is dispensed from the nozzle assembly 52. Simultaneously, the vacuum within the pump chamber 16 opens the input check valve 40 allowing fresh liquid to be drawn from the dispenser container 20 into the liquid supply passage 14 and the pump chamber 16 via the dip-tube 32 in the dispenser container. Thus, each operating cycle of the trigger sprayer 10 after the first cycle causes liquid 30 to be dispensed in a continuous stream on both the charge and return strokes of the trigger 58 and the piston 46 connected thereto.

In order to equalize pressure between the interior of the dispenser container 20 and the atmosphere, the interior of the dispenser container must be vented. In the trigger sprayer of the present invention 10, venting of the dispenser container 20 is achieved by the inclusion of a first vent 88 in a dip tube retainer 44 and a second vent 90 in a wall of the pump chamber 16. The second vent 90 in the wall of the pump chamber 16 is blocked by the piston 46 when the piston is in the charge or at rest position. Venting occurs when the trigger 58 is pulled causing the piston 46 to move inwardly and thereby unblock the second vent 90. When unblocked, second vent 90 allows air from the atmosphere to pass through to the dispenser container 20 via the first vent 88 in the dip tube retainer 44.

While the present invention has been described with regards to particular embodiments, it is recognized that additional variations of the present invention may be devised without departing from the inventive concept.

What is claimed is:

1. A trigger actuated pump sprayer comprising:

a sprayer housing having a pump chamber, a liquid supply passage having a liquid inlet, a liquid discharge passage having a liquid outlet, an input checkvalve and, an output check valve;

wherein the liquid supply passage is in fluid communication with the pump chamber and the liquid discharge passage;

wherein the input check valve and the output check valve are disposed within the liquid supply passage, the input check valve located above the liquid inlet and output check valve located below the liquid discharge passage;

wherein the pump chamber is in fluid communication with the liquid supply passage at a point in-between the input check valve and the output check valve;

a piston slideably received within the pump chamber, for reciprocating movement between a charge position and a return position;

a trigger pivotally connected to the sprayer housing, the trigger connected to the piston by a link, wherein the trigger and the piston connected thereto are movable between the charge position and the return position;

a return spring connected at one end to the sprayer housing and at another end to the trigger;

an elastic liquid storage element in fluid communication with the liquid supply passage and the liquid discharge passage and disposed above the output check valve, wherein the elastic liquid storage element stores a liquid upon a movement of the piston from the charge position to the return position and releases the liquid upon movement of the piston from the return position to the charge position; and wherein when the trigger and the piston connected thereto are moved from the return position to the charge position, vacuum is formed within the pump chamber causing the input check valve to open and the output check valve to close wherein the liquid from a dispenser container is drawn into the pump chamber and the liquid stored in the elastic liquid storage element is released into the liquid discharge passage and dispensed from the liquid outlet.

2. The trigger actuated pump sprayer of claim 1, wherein when the trigger and the piston connected thereto are moved from the charge position to the return position, the pump chamber is pressurized causing the input check valve to close and the output check valve to open wherein a portion of the liquid within the pump chamber is discharged from the liquid outlet of the liquid discharge passage and a portion is stored in the elastic liquid storage element which expands under the liquid pressure.

3. The trigger actuated pump sprayer of claim 1, wherein the liquid discharge passage, liquid supply passage and pump chamber are integrally formed within the sprayer housing.

4. The trigger actuated pump sprayer of claim 1, wherein the elastic liquid storage element comprises a tube.

5. The trigger actuated pump sprayer of claim 4, wherein the elastic liquid storage element comprises a tube formed of plastic.

6. The trigger actuated pump sprayer of claim 1, wherein the return spring comprises a base having two U-shaped spring arms which extend upwardly on either side of the pump chamber and terminate in a prong engageable with the trigger.

7. The trigger actuated pump sprayer of claim 6, wherein the return spring is formed as a single piece of material.

8. The trigger actuated pump sprayer of claim 7, wherein the return spring is formed as a single of plastic.

9. The trigger actuated pump sprayer of claim 1, further including a closure for interfacing the trigger sprayer with a container.

10. The trigger actuated pump sprayer of claim 9, further including a dip tube retainer attachable to the closure for extending a dip tube within a container.

11. A trigger actuated pump sprayer comprising:

a sprayer housing having a pump chamber, a liquid passage having a liquid inlet and a liquid outlet, an input check valve, and an output check valve;

wherein the liquid passage is in fluid communication with the pump chamber; wherein the input check valve and the output check valve are disposed within the liquid passage;

wherein the pump chamber is in fluid communication with the liquid passage at a point in-between the input check valve and the output check valve;

a piston slideably received within the pump chamber, for reciprocating movement between a charge position and a return position;

a trigger connected to the sprayer housing and connected to the piston wherein the trigger and the piston connected thereto are movable between the charge position and the return position;

a spring connected at one end to the sprayer housing and at another end to the trigger;

a liquid storage element in fluid communication with the liquid passage and disposed above the output check valve, wherein the liquid storage element stores a liquid upon movement of the piston from the charge position to the return position and releases the liquid upon movement of the piston from the return position to the charge position; and wherein when the trigger and the piston connected thereto are moved from the return position to the charge position, vacuum is formed within the pump chamber causing the input check valve to open and the output check valve to close wherein the liquid from a dispenser container is drawn into the pump chamber and the liquid stored in the liquid storage element is released into the liquid passage and dispensed from the liquid outlet.

12. The trigger actuated pump sprayer of claim 11, wherein when the trigger and the piston connected thereto are moved from the charge position to the return position, the pump chamber is pressurized causing the input check valve to close and the output check valve to open wherein a portion of the liquid within the pump chamber is discharged from the liquid outlet of the liquid passage and a portion is stored in the liquid storage element.

13. The trigger actuated pump sprayer of claim 11, wherein the liquid passage and pump chamber are integrally formed within the sprayer housing.

14. The trigger actuated pump sprayer of claim 11, wherein the liquid storage element comprises an elastic tube.

15. The trigger actuated pump sprayer of claim 14, wherein the liquid storage element comprises a tube formed of plastic.

16. The trigger actuated pump sprayer of claim 11, wherein the spring comprises abase having two U-shaped spring arms which extend upwardly on either side of the pump chamber and terminate in a prong engageable with the trigger.

17. The trigger actuated pump sprayer of claim 16, wherein the return spring is formed as a single piece of material.

18. The trigger actuated pump sprayer of claim 16, wherein the return spring is formed as a single monolithic component.

19. The trigger actuated pump sprayer of claim 11, further including a closure for interfacing the trigger sprayer with a container.

20. The trigger actuated pump sprayer of claim 19, wherein further including a dip tube retainer attachable to the closure for suspending a dip tube within a container.

* * * * *